United States Patent [19]

Nagashima et al.

[11] Patent Number: 4,909,201

[45] Date of Patent: Mar. 20, 1990

[54] RECOIL STARTER

[75] Inventors: Akira Nagashima, Kawasaki; Junichi Akaike, Chofu, both of Japan

[73] Assignee: Kioritz Corporation, Tokyo, Japan

[21] Appl. No.: 220,896

[22] Filed: Jul. 18, 1988

[51] Int. Cl.[4] ..... F02N 3/02

[52] U.S. Cl. ..... 123/185 BA

[58] Field of Search ..... 123/185 A, 185 B, 185 BA, 123/179 SE, 185 BB

[56] References Cited

U.S. PATENT DOCUMENTS

| | | | |
|---|---|---|---|
| 2,348,547 | 5/1944 | Kissel | 123/185 BA |
| 3,252,452 | 5/1966 | Burkett et al. | 123/185 |
| 3,570,464 | 3/1971 | Morabit et al. | 123/185 |
| 4,350,123 | 9/1982 | Kossek et al. | 123/2 |
| 4,480,605 | 11/1984 | Bloemers | 123/185 BA |
| 4,517,939 | 5/1985 | Kiyooka | 123/198 E |

FOREIGN PATENT DOCUMENTS

| | | | |
|---|---|---|---|
| 2620241 | 11/1976 | Fed. Rep. of Germany . | |
| 1177987 | 4/1959 | France . | |
| 40-21688 | 7/1965 | Japan . | |
| 166346 | 2/1959 | Sweden | 123/185 A |

*Primary Examiner*—Andrew M. Dolinar
*Attorney, Agent, or Firm*—Browdy and Neimark

[57] ABSTRACT

Disclosed is a recoil starter for internal combustion engines. The recoil starter includes a rope outlet portion formed on the casing thereof. A rope guide member adapted to guide the tope abuts from within against a step portion formed in the rope outlet portion. A holding member abuts against this rope guide member to hold it in such a manner that it cannot be separated from the rope outlet portion of the casing.

2 Claims, 2 Drawing Sheets

RECOIL STARTER

BACKGROUND OF THE INVENTION

1. Field of the Invention

This invention relates to a recoil starter for starting an internal combustion engine.

2. The Prior Art

Recoil starters are used for starting internal combustion engines by which operating machines, outboard motors etc. are powered. In conventional recoil starters of this type, a rope guide member provided at the outlet portion and adapted to guide the rope, allowing it to extend outwards, is mounted on the starter casing by means of screwing, fitting, metal eyelets, etc. These methods of mounting of the rope guide member are not satisfactory in respect of the man-hours required for the rope guide member mounting operation, the weight and strength of the parts, etc.

SUMMARY OF THE INVENTION

Accordingly, it is an object of this invention to provide a recoil starter overcoming these problems in the conventional recoil starters and having a simple and convenient configuration.

The recoil starter in accordance with this invention includes a rope outlet portion formed on the casing thereof, said rope outlet portion having a step portion formed therein, a rope guide member abutting against said step portion from within, and a holding member abutting against said rope guide member in such a manner that the rope guide member cannot be separated from the rope outlet portion of the casing.

The construction of this invention enables the rope guide member to be held between members such as casing and kept from coming off, so that the rope guide member mounting operation can be conducted with ease, and the assembling work and the maintenance operation can be facilitated. In other words, in the recoil starter in accordance with this invention, a rope outlet portion is formed on the casing thereof, said rope outlet portion having a step portion formed therein, a rope guide member abutting against said step portion from within, and a holding member abutting against said rope guide member in such a manner that the rope guide member cannot be separated from the rope outlet portion of the casing, with the result that the rope guide member mounting operation can be conducted with ease and with reduced man-hours. This makes it possible to produce a recoil starter which can be positively fixed using light parts serving two or more purposes and to keep the esthetic aspects of the machine concerned in a desirable state.

DETAILED DESCRIPTION OF THE PREFERRED EMBODIMENT

An embodiment of this invention will now be described with reference to the attached drawings.

Figure 1:
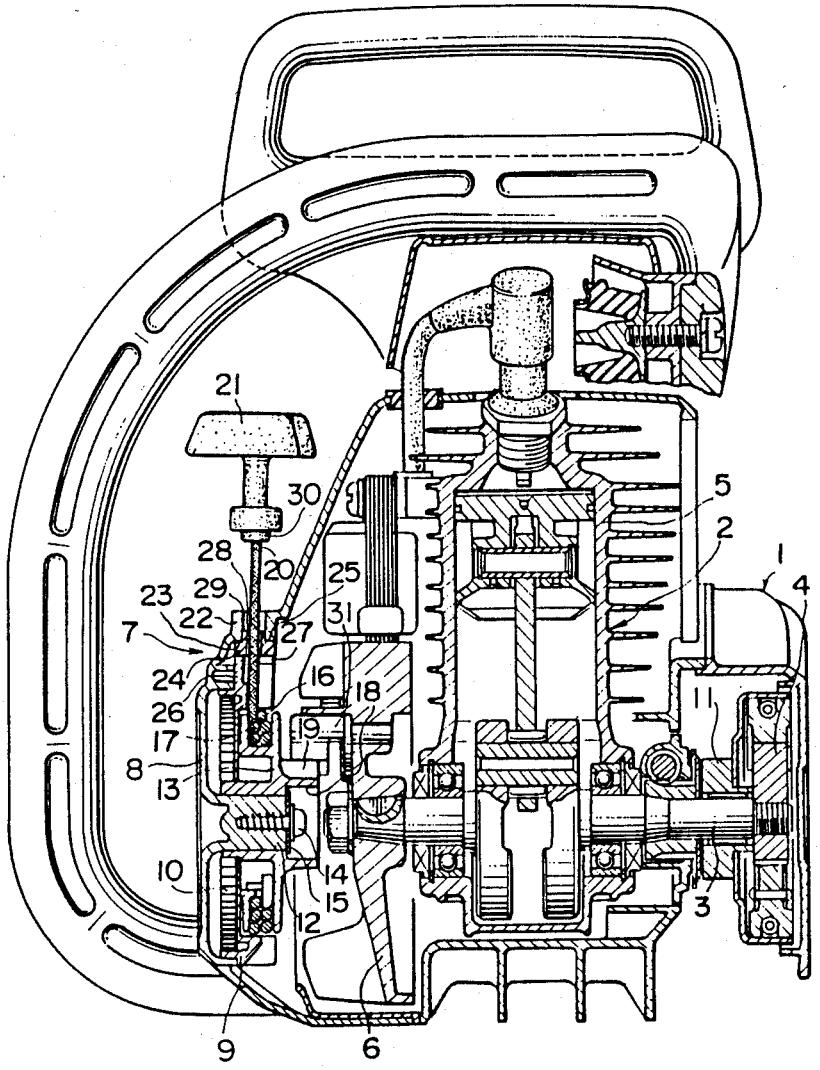
FIG. 1 is a longitudinal sectional view of the essential parts of an embodiment of the recoil starter of this invention as applied to a chain saw.

The embodiment of this invention shown in FIG. 1 is applied to a chain saw. As shown in this figure, this chain saw includes a chain saw body 1 which is equipped with an internal combustion engine 2. A crank shaft 3 of this internal combustion engine 2 is operationally connected at one end thereof to a drive sprocket 11 of the saw chain through the intermediary of a centrifugal clutch 4. Mounted on the other end of the crank shaft 3 is a cooling fan 6 adapted to provide the portion around a cylinder 5 of the internal combustion engine 2 with cooling air for cooling the cylinder 5. A recoil starter 7 is arranged outside the range of the cooling fan 6. Said recoil starter 7 is arranged in such a manner that it can be operationally connected to the crank shaft 3 of the internal combustion engine 2 through the intermediary of said cooling fan 6 and is actuated in a manner described later when starting the internal combustion engine 2.

The recoil starter 7 includes a casing 8 on which a spiral spring case 9 with one end open is mounted. One end of a spiral spring 10 arranged in this case 9 is engaged with the case 9, and the side portion of said spiral spring 10 is held between said one end of the case 9 and said casing 8 in such a manner that it cannot be dislodged. Rotatably attached to a central boss portion 12 of said casing 8 is a rope winding drum 13 which is arranged backside said case 9. At the same time, the other end of said spiral spring 10 is engaged with the rope winding drum 13. A screw 14 and a washer 15 serve to hold the drum 13 in such a manner that it cannot be axially separated from the central boss portion 12 of said casing 8. Inside a deep peripheral groove 16 of said drum 13, open in the peripheral direction, is spirally wound a rope 17, the inner end of which is fixed to the drum 13. An engagement portion 19 provided in an annular boss portion 18 of the drum 13 is detachably connected to a centrifugal engagement member 31. The outer end 20 of the rope 17 is guided in such a manner as will be described later to extend out of the casing 8, a handle 21 being attached to the outmost end thereof.

Figure 2:
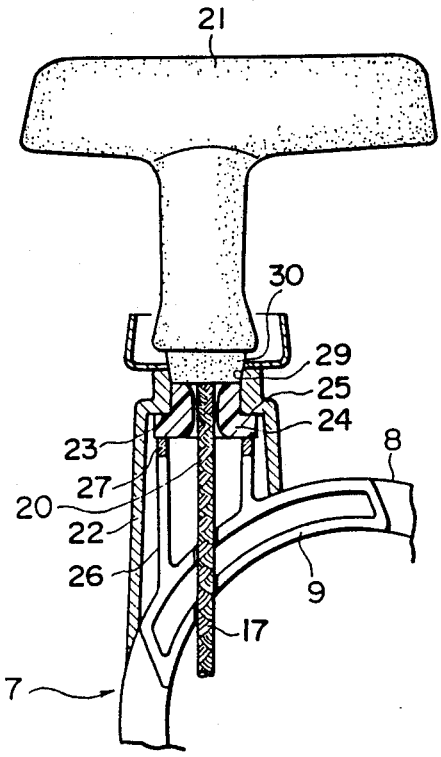
FIG. 2 is an enlarged partial front sectional view of FIG. 1.

In the above-described construction, the rope 17 is normally held inside the peripheral groove 16 of the drum 13 due to the action of the spiral spring 10, and the rope handle 21 is held in the position shown in FIG. 2, i.e. in lodging position, abutting against a rope outlet portion 22. When in starting the engine the operator draws the rope 17 out of the casing 8 against the bias of the spiral spring 10, the drum 13 is rotated, which caused the cooling fan 6 to be operated through the intermediary of the engagement portion 19 of the annular boss portion 18 thereof and the centrifugal engagement member 31, thereby rotating the crank shaft 3 so as to start the internal combustion engine 2.

The casing 8 is preferably formed from a suitable plastic material, and includes, as shown in FIG. 2, said rope outlet portion 22 as an integrally formed portion. Formed in the upper inner section of the rope outlet portion 22 is a narrowed step portion 23 to which a rope guide member 24 formed from a material such as bakelite is attached. Formed on the outer peripheral surface of said rope guide member 24 is a step portion 25 which abuts against the narrowed step portion 23 of the rope outlet portion 22, thereby positioning the rope guide member 24 with respect to the rope outlet portion 22.

On the other hand, a protruding portion 26 formed integrally with the spiral spring case 9 extends upwards into the rope outlet portion 22. The upper end of this protruding portion 26 abuts against the rope guide member 24 from below as a holding member 27 to prevent the rope guide member 24 from being separated from the narrowed step portion 23 of the rope outlet portion 22.

Figure 3:
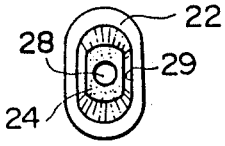
FIG. 3 is a plan view of the rope outlet portion of this embodiment.

The outer end of said rope 17, coming from the spiral spring case 9 and passing through the protruding portion 26 thereof as well as a hole 28 of the rope guide member 24, extends outside the rope outlet portion 22. An upper opening 29 provided in the rope outlet portion 22 of the casing 8 has a non-circular, ellipse-like configuration, as shown in FIG. 3. On the other hand, a base portion 30 of the rope handle 21 mounted on the outer end 20 of said rope 17 has a configuration complementary to the non-circular configuration of the opening 29 of the rope outlet portion 22. Consequently, when the rope handle 21 is in lodging position and the base portion 30 thereof is fitted into the opening 29 of the rope outlet portion 22, the rope handle 21 is lodged, positively oriented in a predetermined direction with respect to the casing 8.

What is claimed is:

1. In a recoil starter for internal combustion engines, the improvement comprising a rope outlet portion formed on a casing of a recoil starter, said rope outlet portion having a narrowed step portion formed in the upper inner section thereof, a detachable rope guide member adapted to guide a rope and having a step portion on the outer peripheral surface thereof which abuts against said narrowed step portion from inside, and a holding member formed integrally with a spiral spring case detachably incased in said casing of the recoil starter abutting against said step portion of said rope guide member from below, thereby holding said detachable rope guide member in such a manner that said rope guide member cannot be separated from said rope outlet portion of said casing when assembled.

2. A recoil starter of claim 1, wherein an upper opening of said rope outlet portion has a non-circular, ellipse-like configuration, and a base portion of a rope handle provided at the outer end of said rope has a configuration complementary to the non-circular configuration of said opening.

* * * * *